US005138292A

United States Patent [19]

Forster

[11] Patent Number: 5,138,292

[45] Date of Patent: Aug. 11, 1992

[54] ENCAPSULATED APPARATUS

[75] Inventor: Joachim Forster, Winnenden, Fed. Rep. of Germany

[73] Assignee: Herion Werke KG, Fellbach, Fed. Rep. of Germany

[21] Appl. No.: 666,246

[22] Filed: Mar. 8, 1991

[30] Foreign Application Priority Data

Mar. 21, 1990 [DE] Fed. Rep. of Germany ..... 9003343

[51] Int. Cl.[5] ..... H01F 7/00; H01F 27/02

[52] U.S. Cl. ..... 335/278; 335/260; 336/96

[58] Field of Search ..... 335/151, 260, 278, 292, 335/300, 303; 336/90, 94, 96; 174/52.2; 264/272.13, 272.14, 272.19, 272.2

[56] References Cited

U.S. PATENT DOCUMENTS

| | | | |
|---|---|---|---|
| 2,743,308 | 4/1956 | Bardsley | 336/96 |
| 3,587,168 | 6/1971 | Kolator | 336/96 |
| 3,683,303 | 8/1972 | Ayano | 336/96 |
| 3,848,331 | 11/1974 | Pavlik | 336/233 |
| 3,860,896 | 1/1973 | Van Der Hoek | 336/96 |
| 4,042,955 | 8/1977 | Imai et al. | 174/52 |
| 4,484,161 | 11/1984 | Barger | 335/217 |
| 4,514,712 | 4/1985 | McDougal | 336/96 |
| 4,814,734 | 3/1989 | Moran | 336/96 |
| 4,849,728 | 7/1989 | Goll et al. | 336/92 |

FOREIGN PATENT DOCUMENTS 60-124808 7/1985 Japan .

*Primary Examiner*—Leo P. Picard
*Assistant Examiner*—Ramon M. Barrera
*Attorney, Agent, or Firm*—Henry M. Feiereisen

[57] ABSTRACT

In an electromagnet of a type including a coil and a ferromagnetic circuit which are arranged in a casing of plastic material or metal, the coil and the ferromagnetic circuit are embedded in an inner casting compound for purposes of fixation and electrical insulation, with a permanently elastic outer casting compound being arranged over the inner casting compound.

12 Claims, 1 Drawing Sheet

ENCAPSULATED APPARATUS

BACKGROUND OF THE INVENTION

The present invention refers to an encapsulated apparatus, and in particular to a cast, explosion-proof electromagnet of a type including a coil and a ferromagnetic circuit which are arranged in a casing of plastic material or metal.

Encapsulation of explosion-proof electromagnets should ensure an electric insulation and prevent explosive gas mixtures from reaching ignition sources. Moreover, such cast electromagnets should withstand mechanical stresses and should be protected from chemical influences, and the encapsulation should be tear-resistant, heat and cold-resistant, chemical-resistant and should display good bonding behavior.

Conventional electromagnets are embedded in a casting compound of cast resin. Practice has shown, however, that flexibility-providing compounds escape from the cast resin resulting in embrittlement and shrinkage and thus to tearing or cracking. Eventually, the casting compound may detach from the casing or the casing may become deformed. Therefore, the casting compound cannot ensure the electric insulation of the electromagnet and provide protection from explosion.

SUMMARY OF THE INVENTION

It is thus an object of the present invention to provide an improved encapsulation for an apparatus obviating the afore-stated drawbacks.

In particular, it is an object of the present invention to provide an electromagnet with improved encapsulation or jacket by which the afore-stated drawbacks ar obviated.

This object and others which will become apparent hereinafter, are attained in accordance with the present invention by embedding the coil and the ferromagnetic circuit within an inner casting compound for purposes of fixation and electrical insulation and by arranging a permanently elastic outer casting compound over the inner casting compound.

Suitably, the inner casting compound is an epoxy resin and the outer casting is a silicone rubber, with the width of the outer casting compound ranging from about 4 to 6 mm, preferably 5 mm. In order to attain an improved stabilization and enhanced heat dissipation, the inner and outer casting compounds contain mineral fillers such as stone dust or quartz.

By embedding the coil and the ferromagnetic circuit within two superimposed casting layers, the drawbacks as set forth above, especially the tear formations at the surface, are essentially prevented.

BRIEF DESCRIPTION OF THE DRAWING

The above and other objects, features and advantages of the present invention will now be described in more detail with reference to the accompanying drawing in which.

DETAILED DESCRIPTION OF A PREFERRED EMBODIMENT

Figure 1:
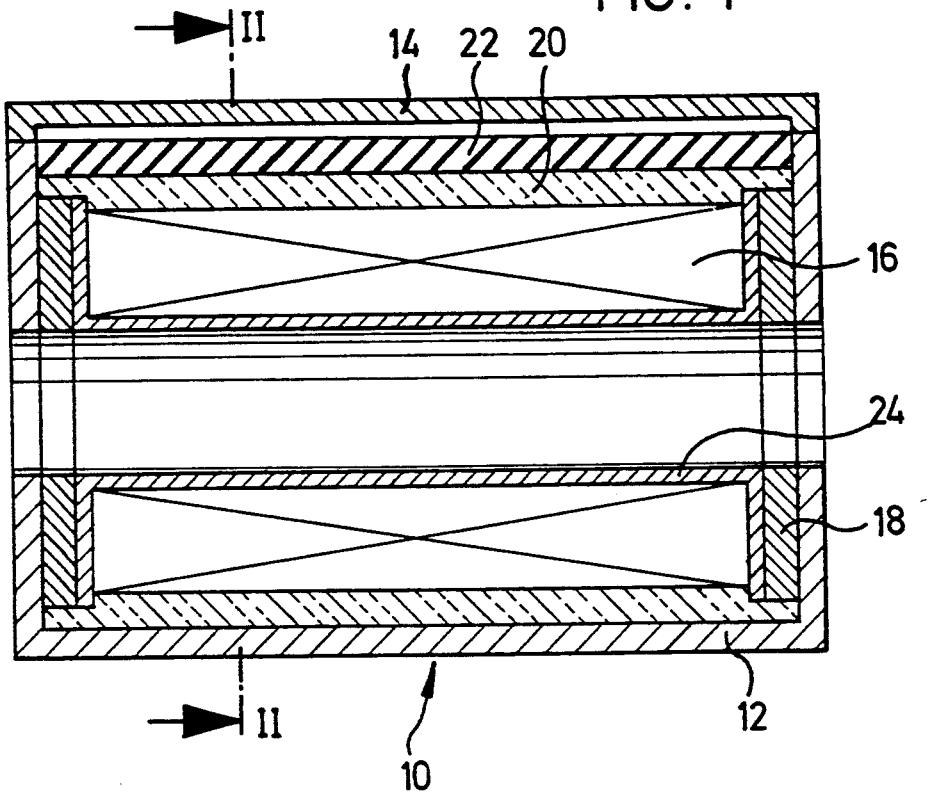
FIG. 1 shows an axial sectional view through one embodiment of an encapsulated apparatus in form of an exemplified electromagnet.
Figure 2:
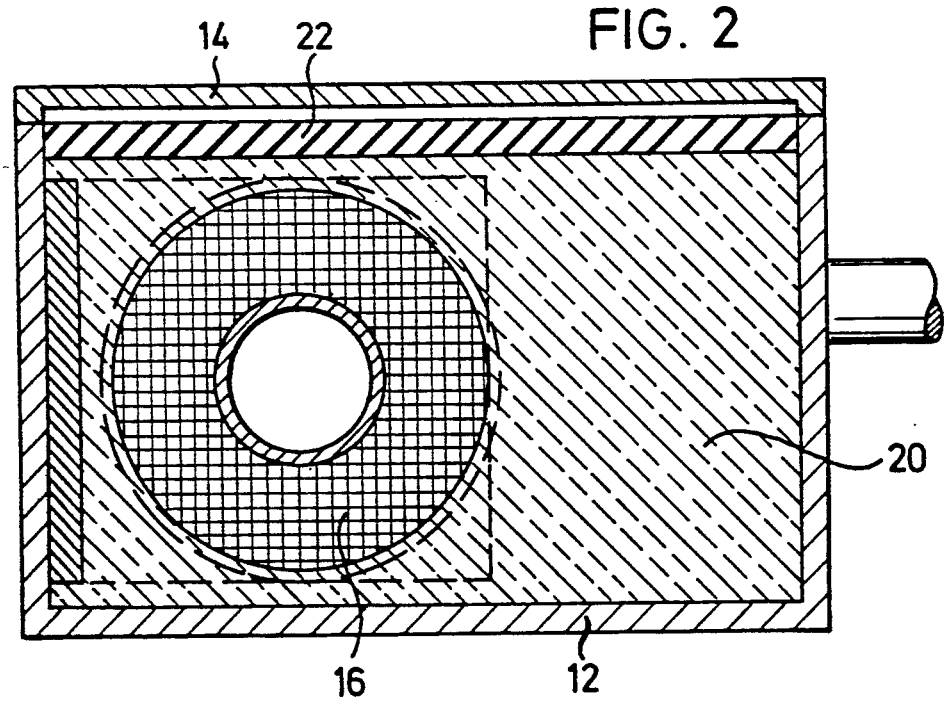
FIG. 2 is a sectional view taken along the line II—II in FIG. 1.

Referring now to FIGS. 1 and 2, there is shown one embodiment of an encapsulated apparatus in form of an exemplified electromagnet generally designated by reference numeral 10. The electromagnet 10 includes a casing 12 of plastic material or metal, with its top closable by a lid 14.

Fitted within the casing 12 is a coil 16, which is wound on a coil form 24, and an iron covering 18 which forms the ferromagnetic circuit and surrounds the winding of the coil 16. As shown in particular in FIG. 2, the coil 16 and the ferromagnetic circuit 18 are cast in an inner casting compound 20 which is made e.g. of epoxy casting resin and by which the coil 16 and the ferromagnetic circuit 18 are secured and fixed and electrically insulated toward the outside.

Suitably, for stabilization, the casting compound 20 may contain a mineral filler such as quartz or stone dust.

Arranged over the inner casting compound 20 is a laminated outer casting compound 22 which is made e.g. of silicone rubber and may also contain mineral fillers such as stone dust or quartz. The casting compound 22 has a thickness in the range of about 4 and 6 mm, preferably 5 mm. It will be appreciated, however, that the thickness may differ from the range as set forth and thus should not be limited thereto.

The outer laminated casting compound 22 is permanently elastic, shows superior bonding properties and is adapted for compensating heat expansion differences. Moreover, the casting compound 22 is tear-resistant, heat-resistant and resistant to chemicals.

While the invention has been illustrated and described as embodied in an encapsulated apparatus, it is not intended to be limited to the details shown since various modifications and structural changes may be made without departing in any way from the spirit of the present invention.

I claim:

1. Encapsulated apparatus, in particular explosion-proof electromagnet of the type including a coil and a ferromagnetic circuit which are fitted in a casing closable by a lid, comprising:

an inner casting compound in which the coil and the ferromagnetic circuit are embedded for fixation and electrical insulation; and a permanently elastic outer casting compound completely covering said inner casting compound along the area facing the lid.

2. Apparatus as defined in claim 1 wherein said outer casting compound has a width ranging from about 4 to 6 mm.

3. Apparatus as defined in claim 2 wherein said outer casting compound has a width of about 5 mm.

4. Apparatus as defined in claim 1 wherein said inner casting compound is an epoxy resin and said outer casting is a silicone rubber.

5. Apparatus as defined in claim 1 wherein said inner and outer casting compounds contain mineral fillers.

6. Apparatus as defined in claim 5 wherein said mineral fillers include stone dust.

7. Apparatus as defined in claim 5 wherein said mineral fillers include quartz.

8. Apparatus as defined in claim 1 wherein said casing is made of plastic material.

9. Apparatus as defined in claim 1 wherein said casing is made of metal.

10. An electromagnet, comprising:

a casing;

a lid adapted for closure of said casing;

a coil and a ferromagnetic circuit arranged in said casing;

an internal casting compound in which the coil and the ferromagnetic circuit are embedded for fixation and electrical insulation; and a permanently elastic outer casting compound completely covering said inner casting compound along the area facing the lid.

11. Encapsulated apparatus, in particular explosion-proof electromagnet of the type including a coil and a ferromagnetic circuit which are fitted in a casing, comprising:

an inner casting compound in which the coil and the ferromagnetic circuit are embedded for fixation and electrical insulation; and a permanently elastic outer casting compound arranged over said inner casting compound wherein said outer casting compound has a width ranging from about 4 to 6 mm.

12. Apparatus as defined in claim 11 wherein said outer casting compound has a width of about 5 mm.

* * * * *